US009763514B2

(12) United States Patent
Blair

(10) Patent No.: US 9,763,514 B2
(45) Date of Patent: Sep. 19, 2017

(54) KNOCK-DOWN FURNITURE

(71) Applicant: Michael Blair, Cincinnati, OH (US)

(72) Inventor: Michael Blair, Cincinnati, OH (US)

( * ) Notice: Subject to any disclaimer, the term of this patent is extended or adjusted under 35 U.S.C. 154(b) by 174 days.

(21) Appl. No.: 14/168,716

(22) Filed: Jan. 30, 2014

(65) Prior Publication Data

US 2014/0143953 A1 May 29, 2014

Related U.S. Application Data

(63) Continuation-in-part of application No. 13/011,438, filed on Jan. 21, 2011, now Pat. No. 8,684,466.

(60) Provisional application No. 61/758,514, filed on Jan. 30, 2013.

(51) Int. Cl.

| | |
|---|---|
| ***A47C 7/00*** | (2006.01) |
| ***A47B 47/00*** | (2006.01) |
| ***A47C 19/00*** | (2006.01) |
| ***A47C 4/02*** | (2006.01) |
| ***A47C 9/00*** | (2006.01) |

(52) U.S. Cl.

CPC ..... *A47B 47/0091* (2013.01); *A47C 4/022* (2013.01); *A47C 9/00* (2013.01); *A47C 19/005* (2013.01)

(58) Field of Classification Search

CPC ..... A47C 4/02; A47C 13/005; A47C 7/42
USPC ... 297/440.1, 440.14, 440.15, 440.16, 440.2, 297/440.21, 440.22, 440.23
See application file for complete search history.

(56) References Cited

U.S. PATENT DOCUMENTS

| | | | | |
|---|---|---|---|---|
| 2,129,555 A | | 9/1938 | Anton | |
| 2,147,437 A | | 2/1939 | Gross | |
| 2,816,342 A | | 12/1957 | Hyre | |
| 3,102,501 A | | 9/1963 | Sutherlan | |
| 3,123,395 A | | 3/1964 | Glass | |
| 3,572,787 A | * | 3/1971 | Timmerman | F16B 12/44 108/156 |
| 3,599,822 A | * | 8/1971 | Johnson | B65D 9/34 217/12 R |
| 3,929,374 A | | 12/1975 | Hogan et al. | |
| 3,973,281 A | * | 8/1976 | Davis | A47C 27/144 297/440.1 |
| 4,067,073 A | * | 1/1978 | Komarov | A47C 4/02 297/440.1 |
| 4,083,464 A | * | 4/1978 | Burnett | B65D 7/24 217/13 |
| 4,140,065 A | | 2/1979 | Chacon | |
| 4,295,432 A | * | 10/1981 | Hulke | A47B 43/006 108/149 |
| 4,305,616 A | * | 12/1981 | Martinez | A47C 4/028 297/411.27 |

(Continued)

OTHER PUBLICATIONS

Lovesac History (2010) at http://www.lovesac.com/history (last visited May 6, 2011), 3 pages.

(Continued)

*Primary Examiner* — Jose V Chen
(74) *Attorney, Agent, or Firm* — Wood Herron & Evans LLP

(57) ABSTRACT

A knock-down furniture component utilizes one or more tensioning mechanisms to draw interlocking framing members, including transversely-oriented interlocking framing members, together between opposed anchor points using directed linear tension between the anchor points and applied by a tensioning device.

19 Claims, 12 Drawing Sheets

(56) References Cited

U.S. PATENT DOCUMENTS 4,453,471 A * 6/1984 Harrington ..... B65D 9/24 108/55.1
4,523,526 A * 6/1985 O'Neill ..... A47B 43/006 108/149
4,523,787 A * 6/1985 Robinson ..... A47C 4/02 297/440.1
4,563,040 A * 1/1986 Alster ..... A47B 3/06 108/155
4,584,806 A * 4/1986 Graham, Jr. ..... E04B 1/6116 217/65
4,609,116 A * 9/1986 Simms ..... B65D 9/12 206/600
4,621,381 A * 11/1986 Schramek ..... A47C 4/028 297/440.13
4,632,459 A 12/1986 Herschlag
4,691,965 A * 9/1987 Hsiung ..... A47C 3/00 297/440.1
4,697,847 A 10/1987 Herschlag
4,796,392 A * 1/1989 Graham, Jr. ..... B65D 19/38 217/43 R
4,904,022 A * 2/1990 Morozzi ..... A47C 3/00 108/156
4,925,245 A * 5/1990 Pendleton ..... A47C 17/14 297/111
5,372,405 A 12/1994 Cash et al.
5,423,596 A * 6/1995 Laughlin ..... A47C 4/02 297/440.1
5,694,656 A * 12/1997 Huang ..... A47C 19/005 297/440.1
5,733,002 A 3/1998 Riley et al.
6,017,093 A * 1/2000 Moser ..... B27M 1/08 297/232
6,267,446 B1 7/2001 Wieland et al.
6,299,011 B1 * 10/2001 Rosenfeldt ..... B65D 9/38 16/388
6,354,232 B1 * 3/2002 Hulke ..... A47B 43/003 108/149
6,367,880 B1 * 4/2002 Niederman ..... A47C 4/02 297/440.14
6,568,058 B1 5/2003 Wieland et al.
6,619,749 B2 9/2003 Willy
6,637,609 B2 * 10/2003 Stevens ..... A47F 5/0892 108/149
6,688,699 B1 2/2004 Bowie
6,752,364 B1 * 6/2004 Lim ..... A47C 19/005 248/188.6
6,814,418 B2 * 11/2004 D'Orso ..... A47B 61/04 108/149
6,827,407 B2 * 12/2004 Niederman ..... A47C 4/02 297/218.1
6,981,747 B2 1/2006 Wieland et al.
6,994,402 B1 * 2/2006 Dodge ..... A47C 17/16 297/440.15
7,014,267 B1 3/2006 Nagar
7,044,557 B2 5/2006 Wieland
7,318,764 B2 1/2008 Elias
7,413,254 B2 8/2008 Petre, Jr.
7,523,989 B2 4/2009 Wieland et al.
7,533,940 B1 5/2009 Zook
7,568,767 B2 8/2009 Richardson
7,575,283 B2 * 8/2009 Crowe ..... A47C 4/02 297/158.1
7,686,173 B2 3/2010 Robinson et al.
7,744,161 B2 6/2010 Berg et al.
7,810,655 B2 * 10/2010 Wang ..... A47B 43/006 108/149
7,832,571 B2 11/2010 Felsenthal
7,922,253 B2 * 4/2011 Chen ..... A47C 4/02 297/440.1
7,984,680 B1 7/2011 Tsai et al.
7,988,236 B2 * 8/2011 Brandtner ..... A47B 91/005 248/188.1
8,001,911 B2 8/2011 Yankello et al.
8,079,315 B2 12/2011 Berent et al.
8,141,723 B2 3/2012 Whalen et al.
8,167,377 B2 5/2012 Kovach
8,181,581 B2 5/2012 Meiners
8,220,398 B1 7/2012 Brandenberg
8,220,399 B2 7/2012 Berent et al.
8,231,301 B1 7/2012 Joyce
8,251,441 B2 8/2012 Alink
8,316,781 B1 11/2012 Majors
8,322,792 B2 * 12/2012 Chen ..... A47C 13/005 297/232
8,356,720 B2 1/2013 Mathews
8,465,101 B1 * 6/2013 Alvarez ..... A47B 95/002 297/182
8,517,189 B2 8/2013 Donohoe
8,701,901 B2 * 4/2014 Gregory ..... A47B 43/006 108/149
8,708,178 B2 * 4/2014 Kvols ..... B65D 19/12 206/600
8,764,114 B1 * 7/2014 Frank ..... A47C 4/028 297/248
8,783,778 B2 * 7/2014 Nelson ..... 248/188
8,813,985 B2 * 8/2014 Schloesser ..... B65D 7/24 206/600
9,266,645 B2 * 2/2016 Eding ..... B65D 25/00
2004/0095000 A1 * 5/2004 Durling ..... A47C 13/005 297/188.2
2005/0006943 A1 1/2005 Wieland
2005/0067876 A1 * 3/2005 Dortch ..... A47C 3/00 297/440.1
2005/0225153 A1 * 10/2005 Ou ..... A47C 4/028 297/440.1
2006/0220435 A1 10/2006 Carter et al.
2006/0279124 A1 * 12/2006 White, III ..... A47C 13/005 297/440.14
2007/0063112 A1 * 3/2007 Patterson ..... A47C 4/02 248/188.6
2008/0191538 A1 8/2008 Berg et al.
2009/0066140 A1 * 3/2009 Berent ..... A47B 3/06 297/440.13
2010/0025520 A1 2/2010 Hahm et al.
2010/0093257 A1 * 4/2010 Elliott ..... A47B 3/06 446/478
2011/0062301 A1 * 3/2011 Sloan ..... A47B 43/003 248/304
2012/0056463 A1 3/2012 Berent et al.
2012/0187737 A1 7/2012 Blair
2013/0005643 A1 1/2013 Kim et al.
2013/0032559 A1 2/2013 Gregory et al.
2013/0048514 A1 * 2/2013 Corcoran ..... A45C 11/00 206/45.23

OTHER PUBLICATIONS

Lovesac—Frequently Asked Questions (2010) at http://www.lovesac.com/faq.html (last visited May 6, 2011), 6 pages.
U.S. Patent and Trademark Office, Office Action issued in related U.S. Appl. No. 13/011,438 dated Jan. 16, 2013.
U.S. Patent and Trademark Office, Final Office Action issued in related U.S. Appl. No. 13/011,438 dated Jul. 17, 2013.
U.S. Patent and Trademark Office, Notice of Allowance issued in related U.S. Appl. No. 13/011,438, dated Nov. 8, 2013.
U.S. Patent and Trademark Office, Supplemental Notice of Allowance issued in related U.S. Appl. No. 13/011,438, dated Jan. 10, 2014.

* cited by examiner

KNOCK-DOWN FURNITURE

CROSS-REFERENCE TO RELATED APPLICATIONS

This application claims the benefit of U.S. Provisional Application No. 61/758,514, filed on Jan. 30, 2013 by Michael Blair, the entire disclosure of which is incorporated by reference herein. This application is also a continuation in part of U.S. patent application Ser. No. 13/011,438, filed on Jan. 21, 2011 by Michael Blair, the entire disclosure of which is also incorporated by reference herein.

FIELD OF THE INVENTION

The present invention relates generally to furniture, and more specifically to knock-down furniture.

BACKGROUND OF THE INVENTION

As individuals grow increasingly more nomadic, the occurrence for individuals to relocate themselves has become more commonplace. Furniture suppliers and manufacturers have embraced this trend by offering economical flat-pack or knock-down furniture. These types of furniture make the task of moving home furnishings easier verses traditionally constructed furniture.

Flat-pack and Knock-down furniture is designed to be sold in a disassembled form and later assembled at a location where the furniture will ultimately be used. This design element naturally makes for easier transport of the furniture in many circumstances. In general, flat-pack furniture tends to be limited to one assembly over the life of the furniture, and thus is difficult if not impossible to disassemble and reassemble at a later point in time. In contrast, knock-down furniture tends to be designed for multiple assemblies and disassemblies over the life of the furniture, which often makes knock-down furniture particularly desirable to consumers who frequently change residences, such as college students and apartment dwellers.

In some cases, another useful feature of knock-down furniture is adaptability. This feature allows for the furniture to not only be easy to transport, but also have the ability to adapt to the confines of a new environment.

A common problem for a number of different knock-down furniture designs results from failure in the fastening hardware components used to maintain the knock-down furniture in an assembled state. Many times cheap hardware is supplied with the furniture, leading to premature failure of the furniture or difficulty in repairing or replacing the hardware. Also, in some instances a consumer will lose or discard customized tools that are provided with the knock-down furniture after the furniture has been assembled, so the tools are no longer available when it is desired to disassemble and/or reassemble the furniture potentially months or years in the future. These problems are compounded when there are different types of fastening hardware components used in a particular design.

Thus, a need continues to exist in the art for knock-down furniture that has the ability to be assembled and disassembled without sacrificing quality, comfort, and/or appearance.

SUMMARY OF THE INVENTION

The invention addresses these and other problems associated with the prior art by compressing interlocking framing members of knock-down furniture, including transversely-oriented interlocking framing members, together between opposed anchor points using directed linear tension between the anchor points.

Therefore, consistent with one aspect of the invention, a knock-down furniture component includes a plurality of framing members configured to engage one another in an interlocking relationship, where the plurality of framing members include first and second framing members, and where at least two framing members among the plurality of framing members are oriented in a generally transverse orientation relative to one another; first and second anchor points respectively coupled to the first and second framing members and separated along a linear axis; and at least one tensioning device that applies tension along the linear axis and between the first and second anchor points to draw the plurality of framing members together under tension in the interlocking relationship.

Consistent with another aspect of the invention, a knock-down furniture component includes first and second anchor points opposing one another along an axis; a planar framing member coupled to the first anchor point and having a surface, where the axis is substantially normal to the surface of the planar framing member; an elongated framing member extending along the axis with at least a portion thereof interposed between the first and second anchor points, where the elongated framing member includes first and second ends and an interior channel disposed therebetween, and where the planar and framing members are configured to engage one another along the axis in an interlocking relationship; and at least one tensioning device that applies tension between the first and second anchor points and draws the planar and elongated framing members together under tension in the interlocking relationship, where at least a portion of the tensioning device extends through the interior channel of the elongated framing member.

Consistent with yet another aspect of the invention, a knock-down bed frame includes a headboard framing member, a footboard framing member and first and second side rail framing members, each framing member including first and second interlocking mechanisms; first, second, third and fourth corner anchors, each corner anchor including an anchor point and first and second interlocking mechanisms, where the first interlocking mechanism of the first corner anchor is configured to engage the first interlocking mechanism of the headboard framing member, where the second interlocking mechanism of the first corner anchor is configured to engage the first interlocking mechanism of the first side rail framing member, where the first interlocking mechanism of the second corner anchor is configured to engage the second interlocking mechanism of the headboard framing member, where the second interlocking mechanism of the second corner anchor is configured to engage the first interlocking mechanism of the second side rail framing member, where the first interlocking mechanism of the third corner anchor is configured to engage the second interlocking mechanism of the first side rail framing member, where the second interlocking mechanism of the third corner anchor is configured to engage the first interlocking mechanism of the footboard framing member, where the first interlocking mechanism of the fourth corner anchor is configured to engage the second interlocking mechanism of the second side rail framing member, and where the second interlocking mechanism of the fourth corner anchor is configured to engage the second interlocking mechanism of the footboard framing member; and first, second, third and fourth tensioning devices, the first tensioning device configured to extend between the anchor points of the first and second corner anchors to draw the first corner anchor, the headboard framing member and the second corner anchor together under tension in an interlocking relationship, the second tensioning device configured to extend between the anchor points of the first and third corner anchors to draw the first corner anchor, the first side rail framing member and the third corner anchor together under tension in an interlocking relationship, the third tensioning device configured to extend between the anchor points of the second and fourth corner anchors to draw the first corner anchor, the second side rail framing member and the fourth corner anchor together under tension in an interlocking relationship, and the fourth tensioning device configured to extend between the anchor points of the third and fourth corner anchors to draw the third corner anchor, the footboard framing member and the fourth corner anchor together under tension in an interlocking relationship.

While the invention will be described in connection with certain embodiments, it will be understood that the invention is not limited to these embodiments. On the contrary, the invention includes all alternatives, modifications, and equivalents as may be included within the spirit and scope of the present invention.

BRIEF DESCRIPTION OF THE FIGURES

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Turning now to the drawings, wherein like numbers denote like parts throughout the several views, embodiments consistent with the invention utilize one or more tensioning mechanisms to draw interlocking framing members of knock-down furniture, including transversely-oriented interlocking framing members, together between opposed anchor points using directed linear tension between the anchor points and applied by a tensioning device.

Figure 1:
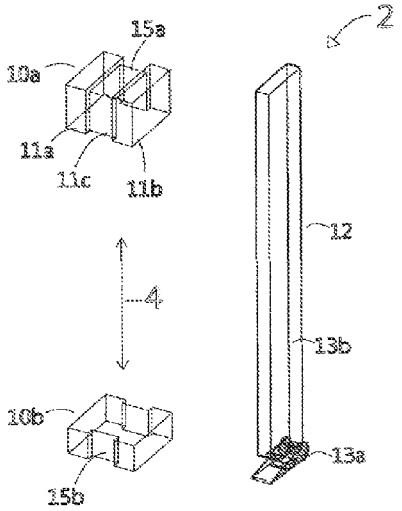
FIG. 1 is a perspective view of an example embodiment of a tensioning mechanism consistent with the invention, and including a pair of anchor points and a tensioning device.

FIG. 1, for example, illustrates an example embodiment of a tensioning mechanism 2 including a pair of opposed anchor points 10*a*, 10*b* separated along a linear axis 4 and a tensioning device 12 suitable for use in securing interlocking framing members together under tension. In this embodiment, anchor points 10*a* and 10*b* are configured to be integrally formed on a framing member, or otherwise mounted to a framing member in a semi-permanent or permanent manner, e.g., through the use of adhesives, screws, nails, rivets and/or other known fasteners or fastening mechanisms. Further, anchor points 10*a* and 10*b* in this embodiment are formed or mounted during manufacture, and thus already formed or mounted to a framing member prior to sale to a consumer, such that the consumer is not required to mount the anchor points to the framing members.

Figure 2:
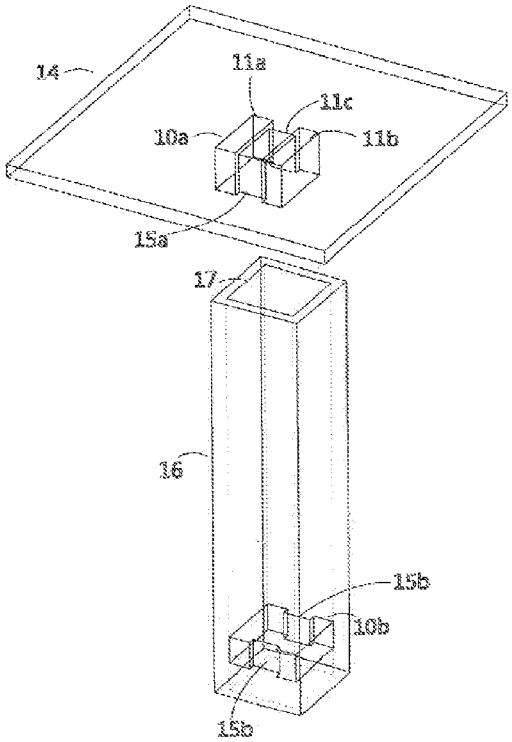
FIG. 2 is an exploded perspective view of a pair of interlocking framing members incorporating the anchor points referenced in FIG. 1.

For example, as illustrated in FIG. 2, anchor points 10*a* and 10*b* are illustrated as respectively mounted to a pair of framing members 14, 16. Framing members 14, 16 are both transversely-oriented relative to one another and interlocking. Framing member 14, for example, is a lateral-type framing member, e.g., a table top, shelf, desk top, seat top, stool top, mantle, ledge, rack, or other type of framing member that is generally horizontally-oriented after assembly, while framing member 16 is a vertical-type framing member such as a table leg, a chair leg, a support, a structural side, a structural wall, a riser, a pillar, a joist, or other type of framing member that is generally vertically-oriented after assembly. As such, at least portions of framing members 14, 16 extend in directions that are generally transverse or orthogonal to one another. In other embodiments, e.g., as illustrated by the bed frame embodiment discussed below, framing members can be transversely-oriented relative to one another without necessarily being horizontally or vertically-oriented after assembly, so the invention is not limited to the enumerated types of framing members discussed above, and may be used to secure together a multitude of different types of framing members.

In addition, in some embodiments the framing members may be transversely-oriented without being specifically at a 90 degree orientation relative to one another. For example, two framing members that extended in directions that are 45 or 60 degrees relative to one another may, in some embodiments, be considered to be transversely-oriented relative to one another. Furthermore, it will be appreciated that in some embodiments more than two framing members may be secured together using a single tensioning mechanism, and as such, some framing members secured together by a tensioning mechanism may be parallel or coaxial relative to other framing members to which they are secured by a tensioning mechanism, e.g., as illustrated by the shelf embodiment discussed below.

As noted above, at least a portion of the framing members secured together by a tensioning mechanism are also interlocking in nature, such that when the framing members are assembled together and secured by a tensioning mechanism, the framing members are generally restricted from movement relative to one another to provide a sturdy furniture component. The interlocking of framing members may generally be dictated by the structural design of each framing member, and may incorporate cooperating slots, tabs, apertures, sleeves, pins, dowels, keys and other types of cooperative joint structures, and in many cases based upon cooperative male and female members, each of which may be referred to herein as a feature. Features may incorporate various structures for keying framing members together, e.g., utilizing keying configurations such as slotting, joinery, pinning, notching, etc. In many embodiments, the interlocking nature of the framing elements is used to restrict movement in one or more directions other than a direction along which tension is applied by a tensioning mechanism.

Collectively, the framing members that are secured together under tension by a tensioning mechanism may be considered to form an interlocking relationship when at least two of the framing members interlock with one another either directly (e.g., in the example shelf discussed below), or in some embodiments through an intermediate member, e.g., an anchor point (e.g., in the example table discussed below).

Figure 3:
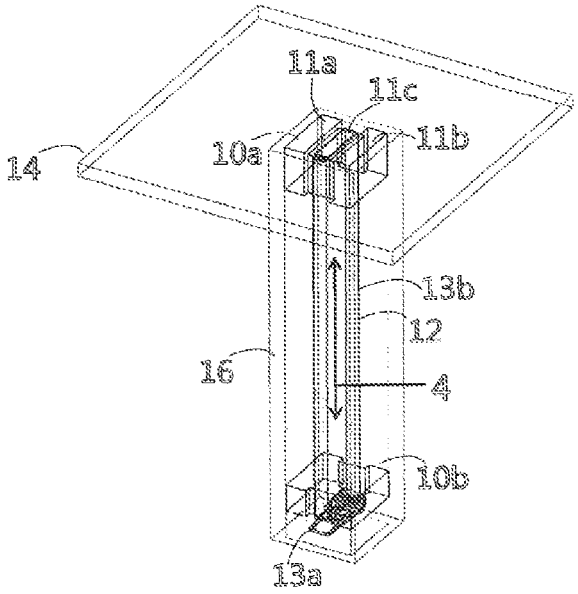
FIG. 3 is a perspective view of the pair of interlocking framing members of FIG. 2 assembled in an interlocking relationship using the tensioning mechanism referenced in FIG. 1.

As shown in FIG. 2, for example, a slot 17 in framing member 16 may be sized and configured to receive anchor point 10*a*, which is in turn integrally formed on framing member 14, such that when anchor point 10*a* is received in slot 17 (as illustrated in FIG. 3), movement of framing member 14 relative to framing member 16 is restricted, thereby interlocking framing members 14 and 16. Other structures suitable for providing an interlocking relationship between framing members are illustrated in the other embodiments discussed hereinafter and/or will be appreciated by one of ordinary skill in the art having the benefit of the instant disclosure.

Framing members 14, 16 may be formed of a number of different materials used for furniture and other structures. In one embodiment, for example, the framing members may be constructed by laser cutting a detailed pattern from plywood, medium density fiberboard ("MDF"), or other manufactured lumber. Additionally, framing members may be manufactured by traditional carpentry methods, fabricated from stamped and/or bent sheet metal, molded from plastic material, etc. In some embodiments, anchor points 10*a*, 10*b* may also be integrally formed in a similar manner. Otherwise, anchor points 10*a*, 10*b* may be formed separately and mounted to the framing members through the use of adhesives and/or various fasteners, as discussed above.

Returning to FIG. 1, tensioning mechanism 2 also includes a tensioning device 12, which generally includes at least one tensioning member configured to apply tension along a linear axis (e.g., linear axis 4) and between opposing anchor points, and a securing mechanism coupled to the at least one tensioning member and configured to control the tension applied through the at least one tensioning member, in some embodiments by controlling an effective length of the at least one tensioning member extending between the opposing anchor points. In the embodiment of FIG. 1, the securing mechanism is implemented as a ratchet 13*a* and the tensioning member is implemented as a strap or band 13*b*, with the ratchet 13*a* configured to adjust an effective length of strap 13*b* such that when strap 13*b* encircles anchor points 10*a*, 10*b*, the anchor points are drawn together under tension applied along the length of the strap. As such, anchor points 10*a*, 10*b* desirably are configured to receive strap 13*b*. While in some embodiments, anchor points 10*a*, 10*b* need not include any structure that restricts the movement of strap 13*b* when no tension is applied, in the illustrated embodiment of FIG. 1, anchor points 10*a*, 10*b* are specifically configured to retain strap 13*b*. Anchor point 10*a*, for example, is formed with three stacked cuboid portions 11*a*, 11*b* and 11*c*, with the dominant faces of the outer cuboid portions 11*a*, 11*b* being larger than that of the inner cuboid portion 11*c* such that a channel 15*a* is defined between the inner cuboid portion 11*c* and the underside of framing member 14 (see FIG. 2). As such, as illustrated in FIG. 3, strap 13*b* may be inserted in through channel 15*a* formed between inner cuboid portion 11*c* and the underside of framing member 14. Anchor point 10*b* may also be formed in a similar manner, and as shown in FIG. 2, channels 15*b* are defined between anchor point 10*b* and an inner wall of framing member 16, and further, channel 15*a* formed by anchor point 10*a* and the underside of framing member 14 extends around and between inner cuboid portion 11*c* of anchor point 10*a* and the inner wall of framing member 16 when framing members 14, 16 are interlocked together.

Figure 8:
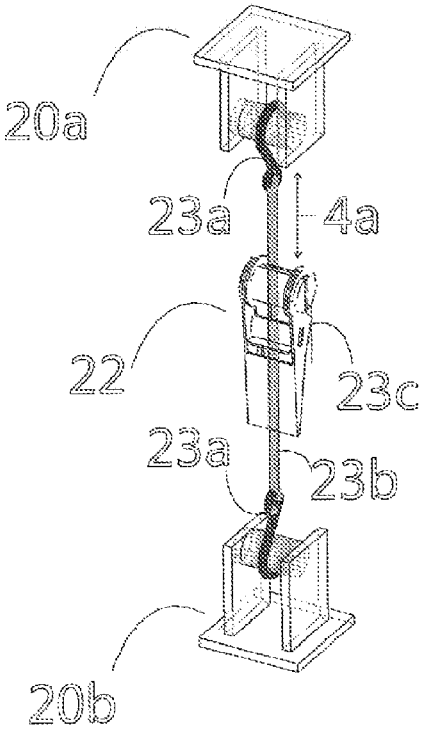
FIG. 8 is a perspective view of another example embodiment of a tensioning mechanism consistent with the invention, and including an point-to-point tensioning device and an opposing opposing pair of the position anchors referenced in FIG. 6.

Tensioning mechanism 2 is configured as a looped tensioning mechanism, as strap 13*b* forms a loop around anchor points 10*a* and 10*b*. In other embodiments, e.g., as illustrated in FIG. 8 below, a point-to-point tensioning mechanism may be used instead, whereby instead of forming a loop, a point-to-point coupling is made between the opposing anchor points, optionally with hooks, rings, karabiners, or other structures suitable for engaging with the anchor points to apply tension to the anchor points and thereby draw the anchor points together, in some embodiments generally along a single, linear axis or direction.

Strap 13*b* is generally formed with a flexible and durable construction, may be woven to improve strength, and may be formed of various elastic or inelastic materials, including various plastics, rubber, metal, natural fibers, or synthetic fibers. In addition, rather than using a strap, a tensioning device 12 consistent with the invention may use another type of tensioning member, e.g., a cord, band, rope, belt, cable, wire, chain, rod or other construction (as well as combinations thereof) that permits tension to be applied to draw opposing anchor points together and apply tension along the length thereof.

In addition, while tensioning mechanism 2 is illustrated with a tensioning device incorporating a securing mechanism implemented as a ratchet 13*a*, it will be appreciated that a tensioning mechanism consistent with the invention may utilize other types of tensioning devices, including hand winches, come-a-longs, turnbuckles, pressure clamps, tension rods, or other devices capable of applying tension along a direction extending between opposing anchor points to thereby draw the anchor points, and their associated and interlocked framing members, together under tension. Other securing mechanisms, e.g., other ratchets, winches, etc., may be used to apply tension to the band. The securing mechanisms are desirably, but not necessarily, capable of being released to enable easy disassembly and reassembly. Moreover, while the illustrated embodiments apply tension via a ratchet that engages both ends of the strap, in other embodiments, one or both ends of the strap may be secured, for example, to the anchor points themselves, e.g., via hooks. In yet other embodiments, a strap may be formed from multiple straps that are joined together in a tensioned relationship by a ratchet or other securing mechanism.

Thus, with reference to FIGS. 2 and 3, to assemble framing members 14, 16 together, strap 13*b* of tensioning mechanism 2 may be inserted through channels 15*a*, 15*b*, and framing member 14 may be interlocked with framing member 16, e.g., with anchor point 10*a* received in slot 17 of framing member 16. Ratchet 13*a* may then be actuated to decrease the effective length of strap 13*b*, and once any slack in the strap 13*b* is taken up, further actuation of ratchet 13*a* applies increasing tension through strap 13*b* and along linear axis 4 to draw the anchor points together, effectively drawing or compressing framing members 14 and 16 together under tension in an interlocking relationship. Disassembly may then be achieved by releasing ratchet 13*a* to remove tension from strap 13*b*, enabling the framing members to be separated and the tensioning device to be removed.

The herein-described functionality may be used in connection with a number of different types of furniture components consistent with the invention. A furniture component, in this regard, may be considered to be a piece or item of furniture, or in the least a structural component of a piece or item of furniture.

As noted above, one residential application of this configuration of furniture component is to provide home furnishings, including knock-down furniture such as tables, chairs, stools, shelving units, desks, cabinets, beds, sofas, loveseats, storage units, dressers, and other types of unupholstered or upholstered furniture, etc., that can be assembled and disassembled, in many instances without the use of hardware or special tools, as the tension applied by the tensioning mechanism coupled with the interlocking nature of the framing members secures the framing members together. When it is time to move, the tension may be removed, the framing members may be separated, and the furniture component can be moved in pieces rather than as a whole. This may allow in some embodiments for one individual to move an item that would traditionally require multiple people to be moved. Additionally, it allows in some embodiments for larger furniture components that would traditionally need to be moved in large vehicle, such as a truck or van, to be moved in a compact car. Another similar application is in corporate or other office environments, where it may be desirable to move furniture between offices and/or locations.

Another commercial application of this configuration is a tradeshow application, wherein tradeshow furniture, e.g., displays, tables, and the like are moved into a particular location such as convention center, used only for a few days, and then moved to another location. In many tradeshow applications, an ability to disassemble and reassemble tradeshow furniture reduces drayage costs and allows disassembled furniture components to be crated with maximum efficiency and reduced drayage trips. In addition, the use of tensioning mechanisms for assembly rather than hardware and tools may also bypass the need for using unionized labor, thereby reducing additional costs associated with exhibiting at tradeshows.

Figure 4:
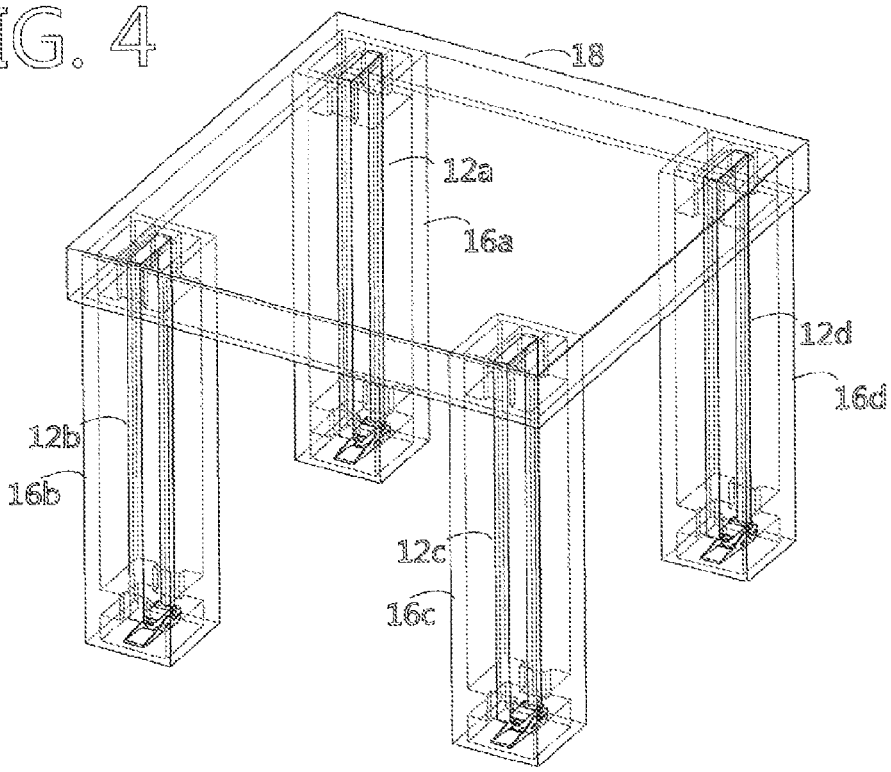
FIG. 4 is a perspective view of a table utilizing the tensioning mechanism referenced in FIG. 1.
Figure 5:
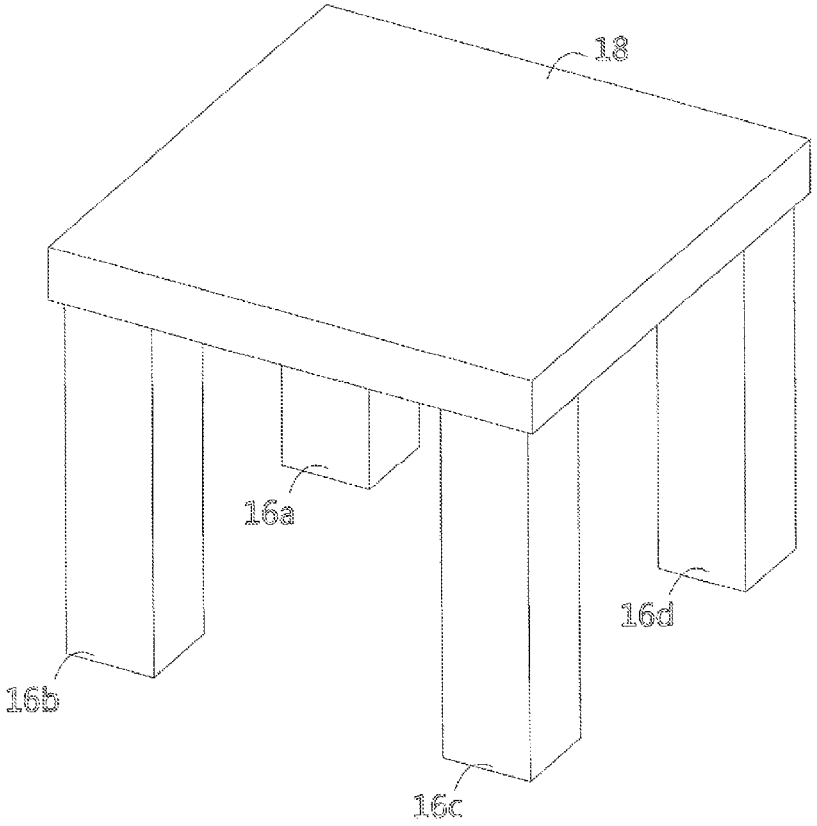
FIG. 5 is a perspective solid view of the table of FIG. 4.

Now turning to FIG. 4, this figure illustrates an example table constructed and assembled in accordance with the techniques described above. In particular, a tabletop 18, configured as a lateral-type framing member, is shown secured to four table legs 16*a*-16*d*, configured as vertical-type framing members similar to framing member 16 of FIGS. 2-3. Tensioning devices 12*a*-12*d*, configured similar to tensioning device 12 of FIG. 1, utilize anchor points similar to anchor points 10*a*, 10*b* of FIG. 1 to form tensioning mechanisms that draw together tabletop 18 and table legs 16*a*-16*d* under tension into interlocking relationships. It should be noted that in this configuration each tensioning device 12*a*-12*d* is primarily encased within the respective framing members 16*a*-16*d*, and thus, as illustrated in FIG. 5, the tensioning devices are generally hidden from view in the assembled table.

Figure 6:
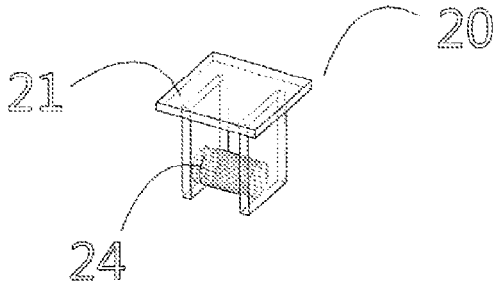
FIG. 6 is a perspective view of a position anchor suitable for use with example embodiments of a tensioning mechanism consistent with the invention.

FIG. 6 next illustrates another type of anchor point, position (P) anchor 20, which may be used in some embodiments consistent with the invention. P anchor 20, in one embodiment, is not integrated into a framing member, but it is instead configured to interlock with a framing member at a pre-determined, structurally-beneficial position on the framing member. A P anchor may be molded or fabricated from a dense and/or durable material such as a metal or plastic material, and may be, for example, formed of a structurally stronger material than the framing member to which it is interlocked. In some embodiments, a P anchor may be received in a corresponding aperture in a framing element and further may be removable therefrom after disassembly.

Figure 7:
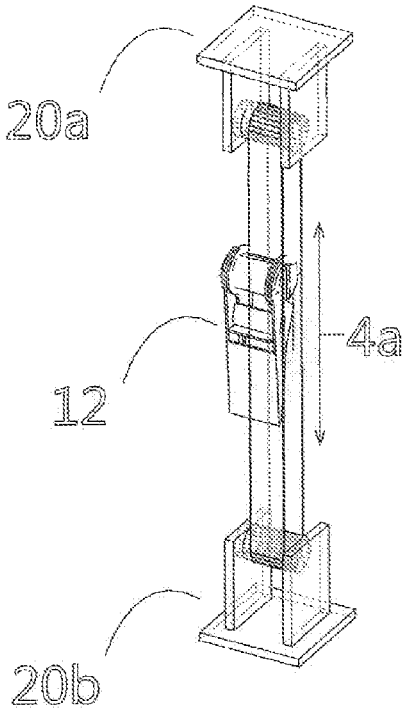
FIG. 7 is a perspective view of one example embodiment of a tensioning mechanism consistent with the invention, and including a looped tensioning device and an opposing opposing pair of the position anchors referenced in FIG. 6.
Figure 9:
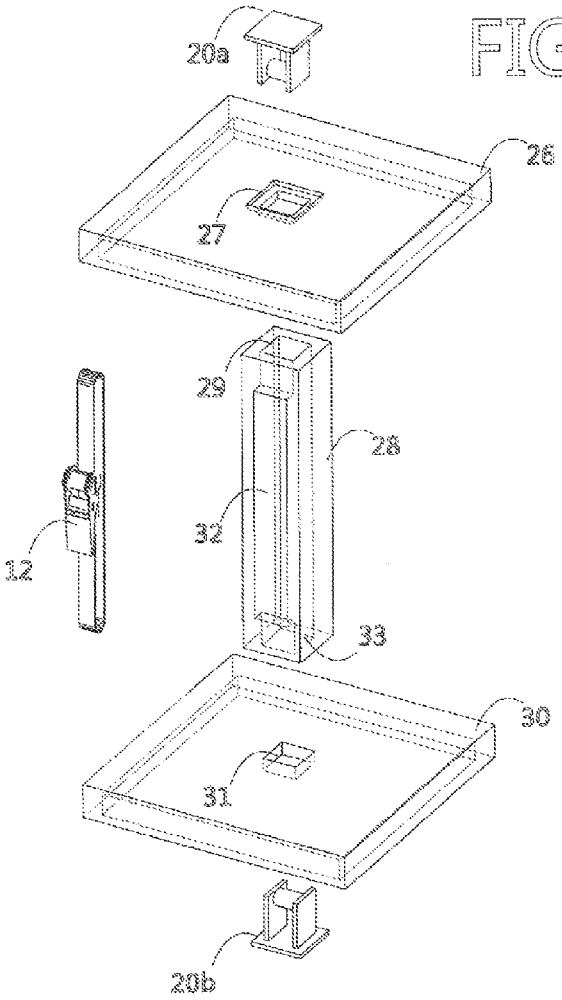
FIG. 9 is an exploded perspective view of a plurality of interlocking framing members and the tensioning mechanism referenced in FIG. 7, for use in an example stool consistent with the invention.

P anchor 20 includes a cleat point 24, e.g., incorporating a cylindrical bar extending between a pair of opposing supports. In addition, P anchor 20 includes a plate 21 that, as may be seen, for example, in FIG. 9, is sized and configured to interlock P anchor 20 with a framing member (e.g., framing member 26 of FIG. 9) such that tension applied to the cleat point 24 is likewise communicated to the associated framing member. In addition, as shown in FIG. 7, when used in a tensioning mechanism incorporating a looped tensioning device such as tensioning device 12, cleat point 24 serves to re-direct the force of the tensioning device 12 by turning cycled linear tension into compression between opposing P anchors 20*a*, 20*b*, generally along linear axis 4*a*, thereby drawing the P anchors 20*a*, 20*b* toward one another.

P anchor 20 may also be used in connection with a point-to-point tensioning device. As shown in FIG. 8, for example, P anchors 20*a*, 20*b* may be secured to one another using a point-to-point tensioning device 22 including opposing hooks 23*a* that engage with cleat points 24 of P anchors 20*a*, 20*b*, and that are mounted at opposing ends of a cord 23*b* (which may be multi-part) coupled to a ratchet 23*c*, thereby applying tension or compression between P anchors 20*a*, 20*b* along linear axis 4*a*.

Figure 10:
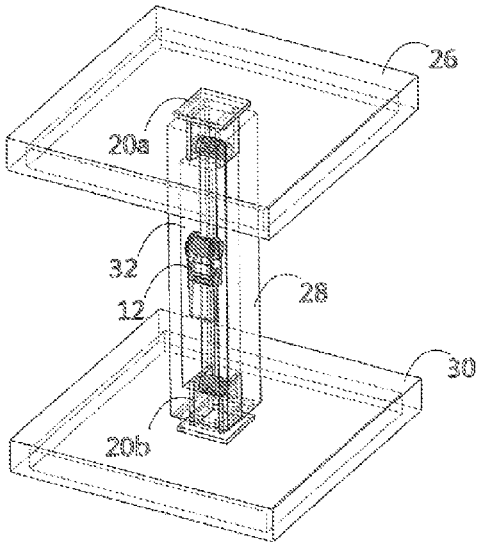
FIG. 10 is a perspective view of the example stool referenced in FIG. 9 after assembly.
Figure 11:
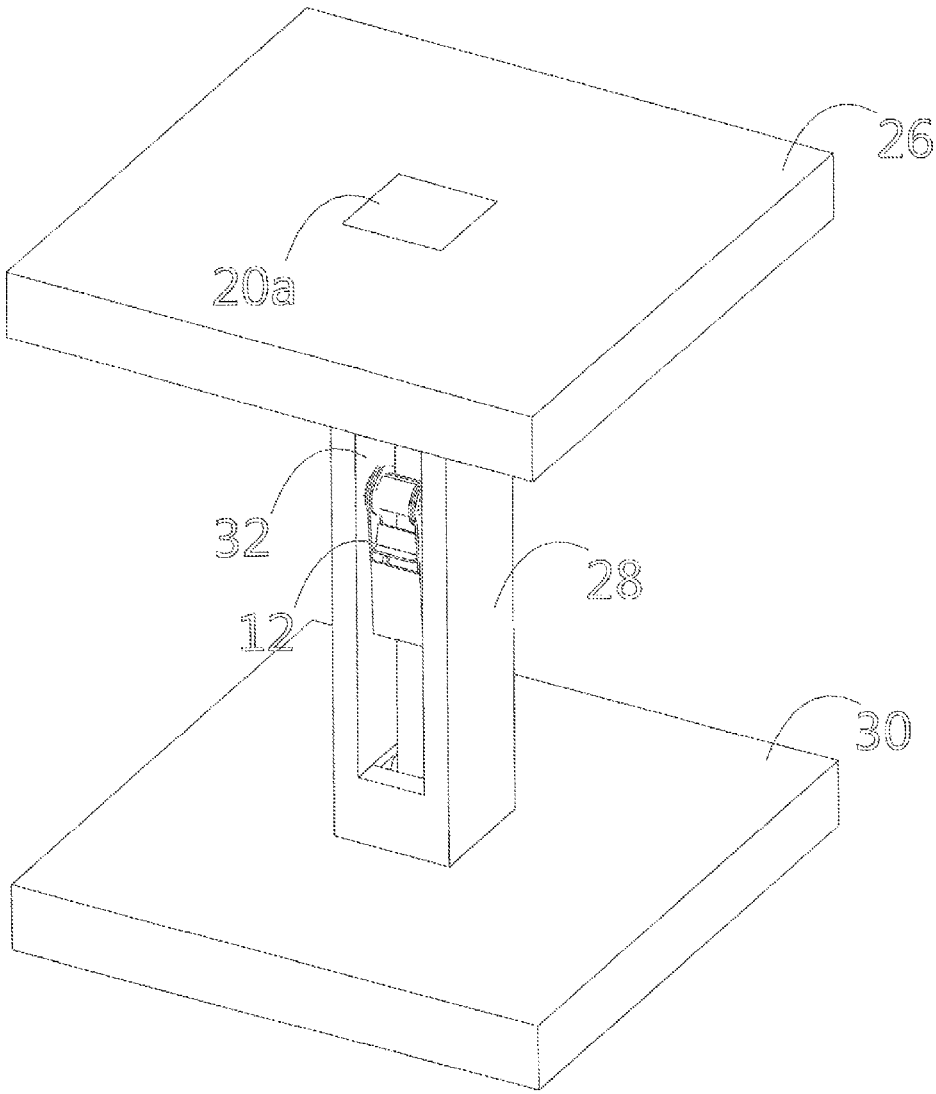
FIG. 11 is a perspective solid view of the example stool of FIG. 10.

FIGS. 9-21 next illustrate a number of different furniture components or items that may utilize the tensioning mechanisms described herein. For example, FIGS. 9-11 illustrate the construction and assembly of an example stool utilizing the P anchors of FIGS. 6-8. As shown, a pair of lateral-type framing members 26, 30, respectively representing the seat and base of the stool, are secured to opposing ends of a vertical-type framing member 28 by a tensioning mechanism including a tensioning device 12 and P anchors 20*a*, 20*b*.

To assemble the sample stool, P anchor 20*b* may be interlocked with lateral-type framing member 30 through a slot 31, and may be sized and configured to project beyond the upper surface of framing member 30. As such, framing member 28 may be placed over P anchor 20*b* such that P anchor 20*b* projects into a slot 33 in framing member 28. Next, P anchor 20*a* may be interlocked with lateral-type framing member 26 through a slot 27, and may be sized and configured to project beyond the underside of framing member 26. As such, P anchor 20*a* may inserted into slot 29 of framing member 28 to set lateral-type framing member 26 on top of the entire assembly.

Also, in this embodiment, framing member 28 includes an opening 32 through which tensioning device 12 may be inserted to loop the strap thereof around the cleat point of each P anchor 20*a*, 20*b*, and the ratchet of the tensioning device may be actuated to apply tension to the strap and thereby compression lock framing members 26, 28, and 30 together under tension in an interlocking relationship. As illustrated in FIG. 11, when the stool is assembled, tensioning device 12 is primarily encased in framing member 28, but may still be visible through opening 32. In other embodiments, however, a framing member similar to framing member 16 of FIGS. 2-3 may be used, whereby tensioning device 12 may be hidden from view.

Figure 12:
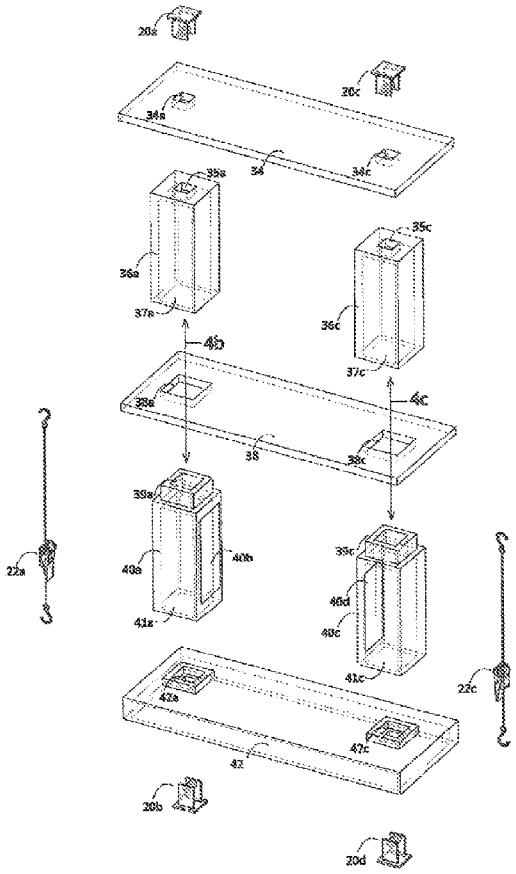
FIG. 12 is an exploded perspective view of a plurality of interlocking framing members and the tensioning mechanism referenced in FIG. 8, for use in an example shelf consistent with the invention.
Figure 13:
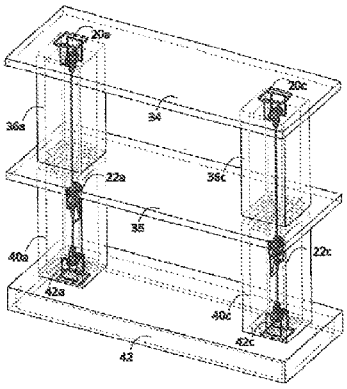
FIG. 13 is a perspective view of the example shelf referenced in FIG. 12 after assembly.
Figure 14:
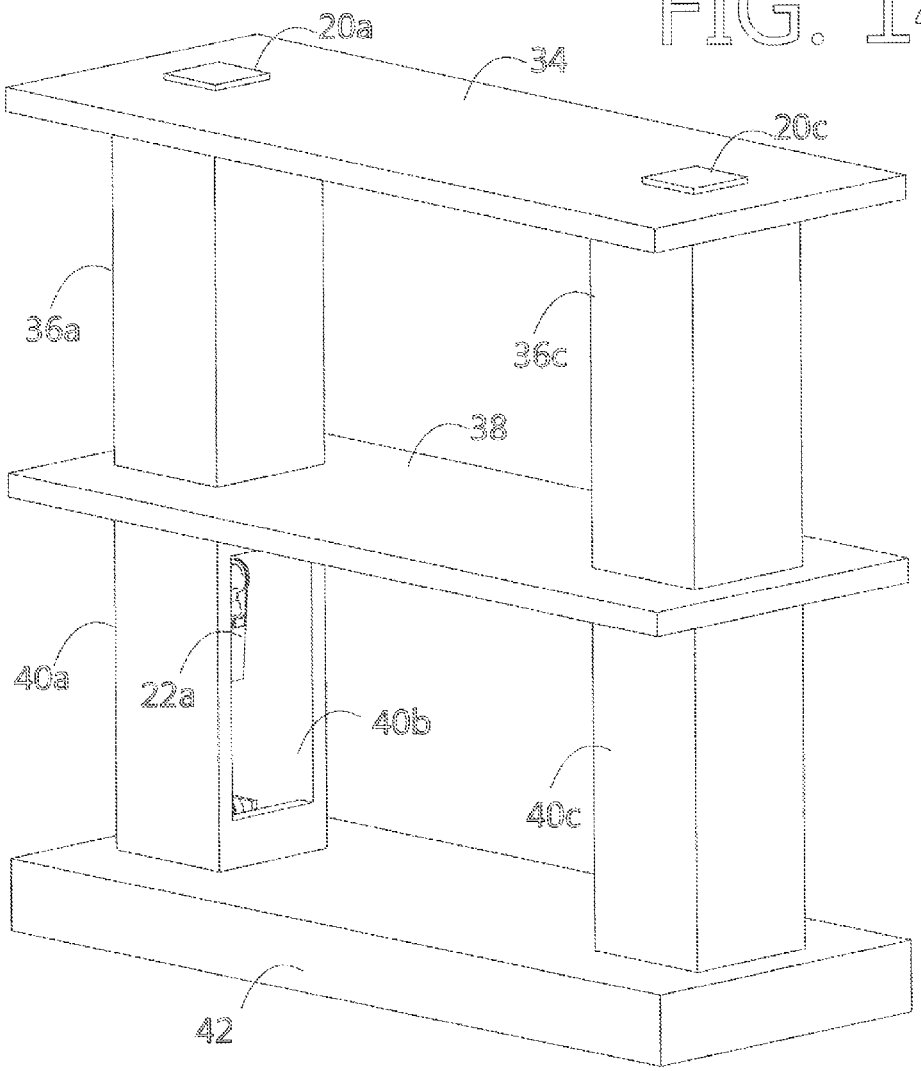
FIG. 14 is a perspective solid view of the example shelf of FIG. 13.

FIGS. 12-14 next illustrate an example shelf or bookcase that may utilize the P anchors of FIGS. 6-8. As shown in FIG. 12, the shelf may include four vertical-type framing members 36*a*, 36*c*, 40*a*, 40*c*, three lateral-type framing members 34, 38, and 42 (with framing members 34 and 38 serving as shelves and framing member 42 serving as a base), and two tensioning mechanisms, a first including two P anchors 20*a* and 20*b* and a tensioning device 22*a* to apply tension along a linear axis 4*b*, and a second including two P anchors 20*c* and 20*d* and a tensioning device 22*c* to apply tension along a linear axis 4*c*. Tensioning devices 22*a* and 22*c* are similar to tensioning device 22 of FIG. 8, although in other embodiments, a tensioning device similar to tensioning device 12 may be used.

To assemble the example shelf, P anchors 20*b* and 20*d* may be interlocked to features 42*a* and 42*c* of lateral-type framing element 42, and vertical-type framing elements 40*a* and 40*c* may be placed on features 42*a* and 42*c* such that P anchors 20*b* and 20*d* and features 42*a* and 42*c* are received in cooperative slots 41*a* and 41*c* of framing elements 40*a* and 40*c*. Lateral-type framing element 38 may then be placed on top of framing elements 40*a* and 40*c* such that features 39*a* and 39*c* thereof project through slots 38*a* and 38*c* in framing member 38. Features 39*a* and 39*c* may be sized and configured to project beyond the upper surface of framing member 38 such that vertical-type framing members 36*a* and 36*c* may be placed on top of framing member 38 with slots 37*a* and 37*c* thereof receiving features 39*a* and 39*c* of framing members 40*a* and 40*c*.

P anchors 20*a* and 20*c* may then be interlocked with slots 34*a* and 34*c* in lateral-type framing member 34, and framing member 34 may be placed on framing members 36*a* and 36*c* such that P anchors 20*a* and 20*c* interlock with slots 35*a* and 35*c* of framing members 36*a* and 36*c*.

Framing members 40*a* and 40*c* respectively include openings 40*b* and 40*d* through which tensioning devices 22*a* and 22*c* may be inserted to respectively engage their hooks with P anchors 20*a*/20*b* and 20*c*/20*d*, and the ratchets of the tensioning devices 22*a* and 22*c* may be actuated to apply tension to the cords and thereby compression lock framing members 36*a*, 36*c*, 40*a*, 40*c*, 34, 38, and 42 together under tension in an interlocking relationship. As illustrated in FIG. 14, when the shelf is assembled, tensioning devices 22*a* and 22*c* are primarily encased in vertical-type framing members 36*a*, 36*c*, 40*a* and 40*c*, but may still be visible through openings 40*b* and 40*d* of framing members 40*a* and 40*c*. In other embodiments, however, a framing member similar to framing member 16 of FIGS. 2-3 may be used, whereby tensioning devices 22*a* and 22*c* may be hidden from view. In addition, it will be appreciated that framing members not in direct contact, but nonetheless in a linear or coaxial orientation with tensioning devices 22*a* and 22*c* are all pressure locked together under a common channel of compressing force.

The shelf illustrated in FIGS. 12-14 also illustrates a number of different interlocking arrangements between framing elements. In some embodiments, for example, a furniture component may include at least one planar framing member, e.g., a table top, shelf, desk top, seat top, stool top, mantle, ledge, or rack and at least one elongated and at least partially hollow framing member, e.g., a table leg, a chair leg, a support, a structural side, a structural wall, a riser, a pillar, a joist that interlocks with the planar framing member proximate one end thereof and in a generally transverse orientation, e.g., with an axis of the elongated framing member being generally normal to a surface of the planar framing member, and that includes an interior channel disposed at least partially between the opposing ends of the elongated framing member through which at least a portion of a tensioning device may extend. The interlocking may be implemented, for example, via an aperture in the planar member through which a feature of the elongated framing member projects partially or completely (e.g., as is the case with framing members 38 and 40*a*), via a feature of the planar member or an anchor point coupled thereto that projects into a slot formed in the end of an elongated framing member (e.g., as is the case with framing members 42 and 40*a*, as well as in the arrangement illustrated in FIGS. 2-3). Opposing anchor points are defined along the axis of the elongated framing member such that the axis is substantially normal to the surface of the planar framing member, and such that at least a portion of the elongated framing member is interposed between the opposing anchor points.

Figure 15:
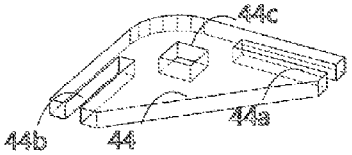
FIG. 15 is a perspective view of an angle anchor for use in a tensioning mechanism consistent with the invention.
Figure 16:
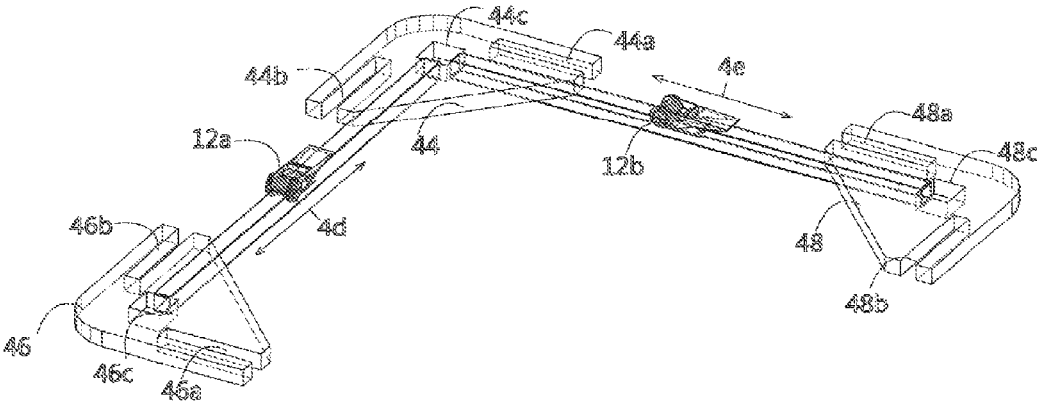
FIG. 16 is a perspective view of a pair of tensioning mechanisms consistent with the invention and formed from three of the angle anchors referenced in FIG. 15 and a pair of tensioning devices.

FIGS. 15-21 next illustrate an example bed frame utilizing tensioning mechanisms according to another embodiment of the invention. FIG. 15, in particular, illustrates another example anchor point configuration referred to herein as a corner (C) anchor 44 including two substantially perpendicular interlocking slots or features 44*a*, 44*b* set at about a 90 degree angle relative to one another, along with an interior slot 44*c* functioning as a tension cleat. FIG. 16 illustrates C anchor 44 being used as a common anchor point for two tensioning mechanisms, a first including C anchor 44 along with a similarly configured C anchor 46 and a tensioning device 12*a* (the strap of which is looped through slots or cleats 44*c* and 46*c*) to apply tension along a linear axis 4*d*, and a second including C anchor 44 along with a similarly configured C anchor 48 and a tensioning device 12*b* (the strap of which is looped through slots or cleats 44*c* and 48*c*) to apply tension along a linear axis 4*e*. C anchors 46, 48 are similar or identical to C anchor 44, and include similarly-configured slots 46*a-c* and 48*a-c*. It will be appreciated that C anchors may be manufactured to support intersecting angles other than 90 degrees, and thus may be suitable for use in constructing a wide variety of furniture configurations. C anchor 44, as shown in FIG. 16, provides opposition for opposing C anchors 46 and 48, and thereby provides two channels of compression from tensioning devices 12*a* and 12*b*.

Figure 17:
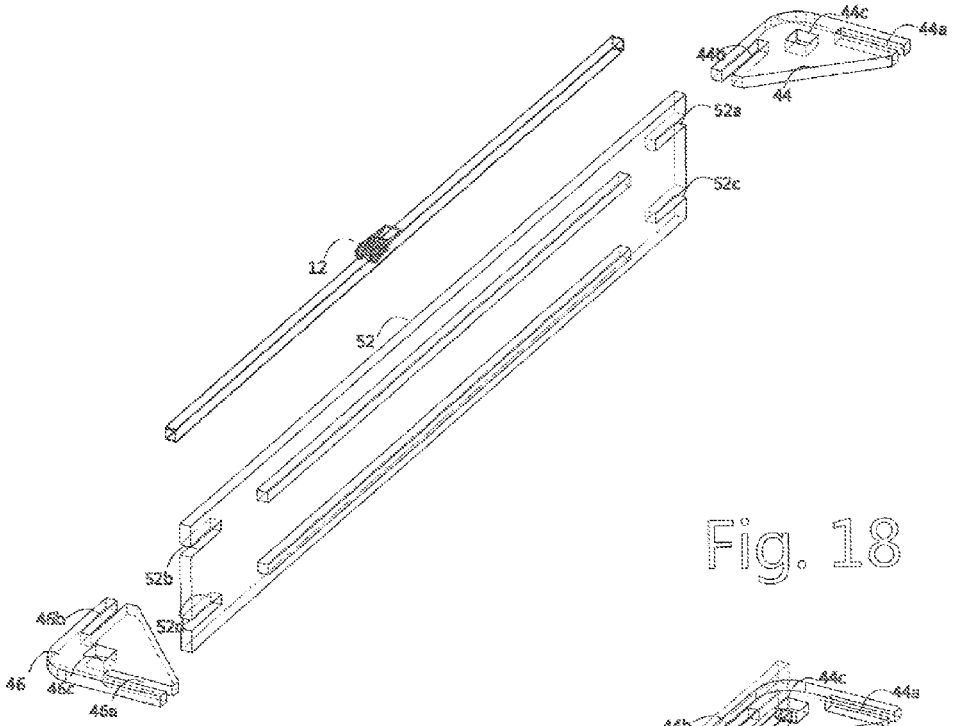
FIG. 17 is an exploded perspective view of one of the tensioning mechanisms referenced in FIG. 16 and a framing member for a bed frame.
Figure 18:
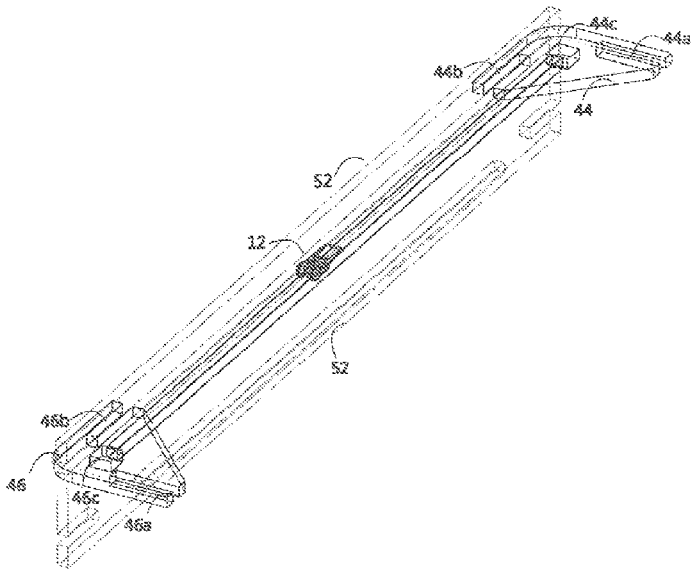
FIG. 18. is a perspective view illustrating engagement of the tensioning mechanism and framing member referenced in FIG. 17.

FIG. 17 next illustrates a framing member 52 interposed between C anchors 44 and 46. Framing member 52 includes a slot or feature 52*a* that interlocks with feature 44*b* of C anchor 44, as well as a slot or feature 52*b* that interlocks with feature 46*b* of C anchor 46. As shown in FIG. 18, when tensioning device 12 is looped through slots 44*c* and 46*c* of C anchors 44 and 46 while framing member 52 is interlocked with C anchors 44 and 46, a channel of compression is formed by tensioning device 12*a* to draw C anchors 44 and 46 and framing member 52 together in tension and in an interlocking relationship.

As also illustrated in FIG. 17, it may be desirable in some embodiments to interlock a framing member 52 with multiple C anchors at each end thereof, e.g., using slots or features 52*a*-52*d*. Thus, two or more stacked C anchors may be disposed at each end of a framing member to provide additional support in some embodiments.

It should be noted that, in this embodiment, a C anchor effectively serves a dual function as both a framing member and an anchor point. Thus, for example, C anchors 44, 46 and framing member 52 collectively engage one another in an interlocking relationship. Furthermore, framing member 52 is oriented in a generally transverse orientation relative to C anchors 44, 46. Moreover, opposing anchor points, taking the form of slots or tension cleats 44*c*, 46*c*, are respectively defined on or otherwise coupled to C anchors 44, 46, such that tensioning device 12 applies tension between these anchor points and draws the C anchors 44, 46 and framing member 52 together under tension in the interlocking relationship.

Figure 19:
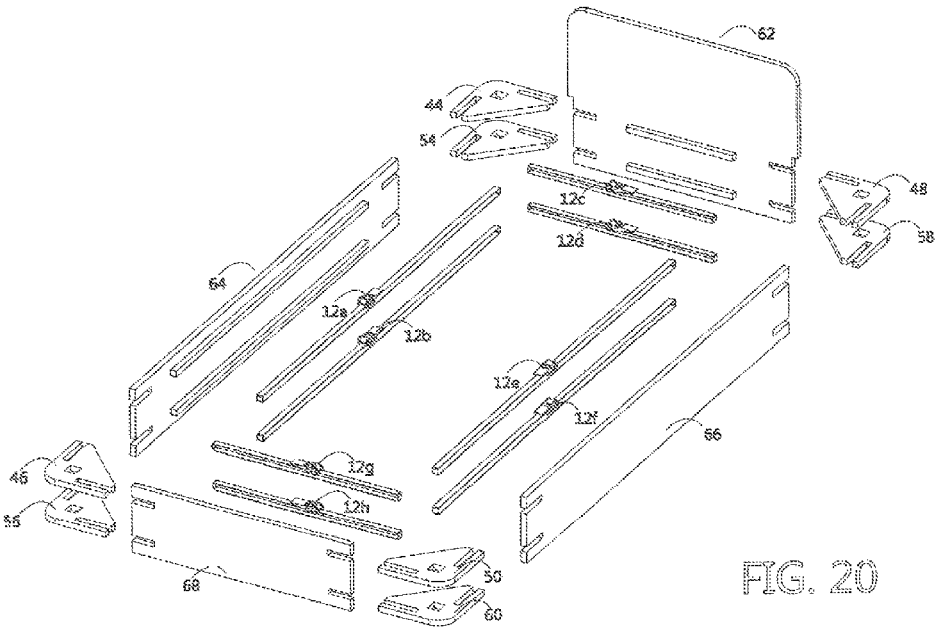
FIG. 19 is an exploded perspective view of a plurality of framing members and the tensioning mechanism referenced in FIGS. 15-18, for use in an example bed frame consistent with the invention.

Now turning to FIG. 19, a complete bed frame may be assembled from components similar to those described above in connection with FIGS. 15-18, including framing member 62 (serving as a headboard), framing members 64 and 66 (serving as side rails), framing member 68 (serving as a footboard), C anchors 44, 46, 48, 50, 54, 56, 58 and 60 and tensioning devices 12*a*-12*h* (configured similarly to tensioning device 12 of FIG. 1).

Figure 20:
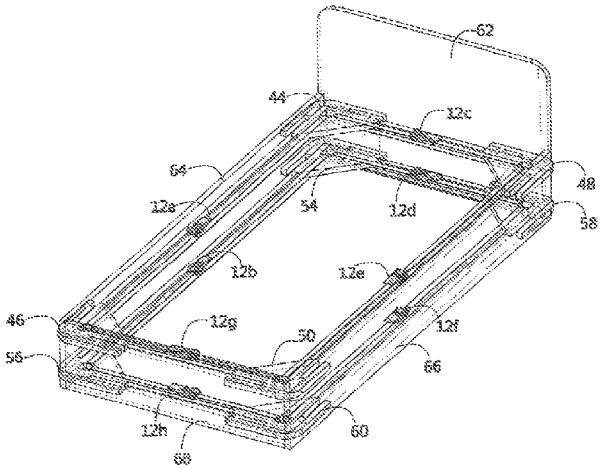
FIG. 20 is a perspective view of the example bed frame referenced in FIG. 19 after assembly.
Figure 21:
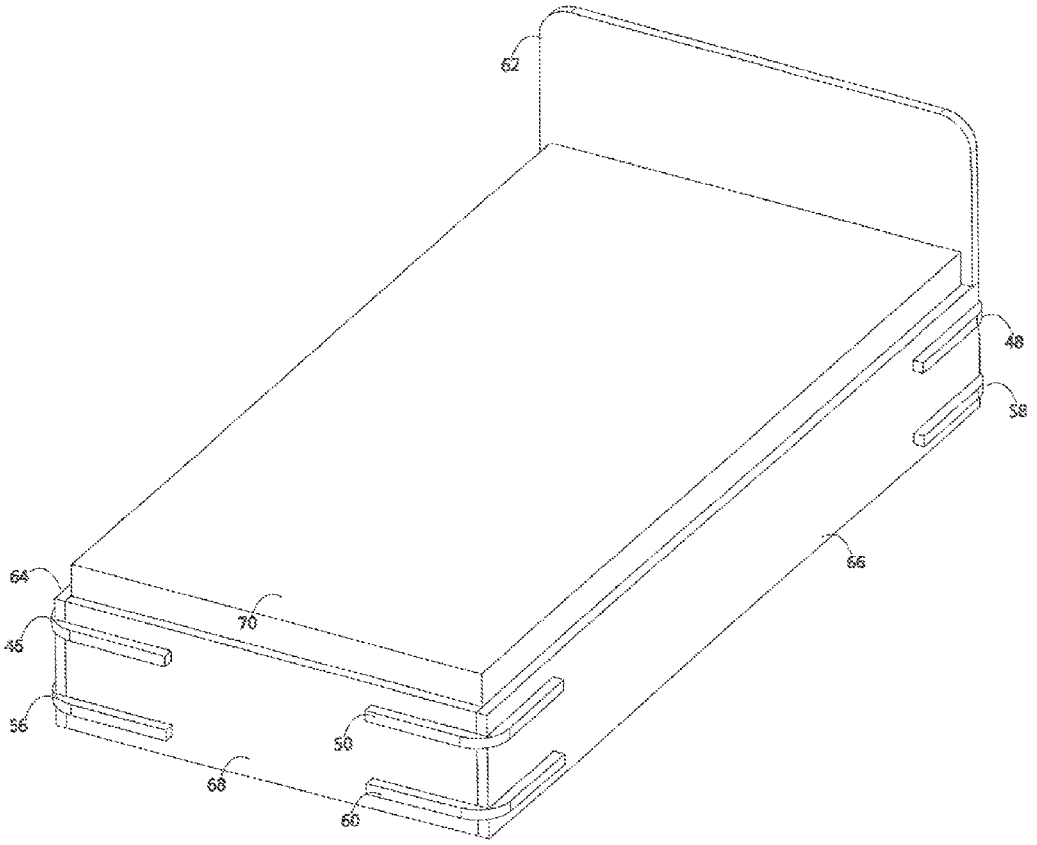
FIG. 21 is a perspective solid view of the example bed frame of FIG. 20.

To assemble the sample bed frame, C anchors 44 and 48 may be pressure locked onto framing member 62 using tensioning device 12*c*, C anchors 54 and 58 may be pressure locked onto framing member 62 using tensioning device 12*d*, C anchors 46 and 50 may be pressure locked onto framing member 68 using tensioning device 12*g* and C anchors 56 and 60 may be pressure locked onto framing member 68 using tensioning device 12*h*. C anchors 44 and 46, and C anchors 54 and 56, may be pressure locked onto framing member 64 using respective tensioning devices 12*a* and 12*b*, while C anchors 48 and 50, and C anchors 58 and 60, may be pressure locked onto framing member 66 using respective tensioning devices 12*e* and 12*f*, thereby completing assembly of the example bed frame, as illustrated in FIG. 20. In addition, as shown in FIG. 21, when a mattress 70 is placed on the bed frame, and supported by C anchors 44-50, tensioning devices: 12*a*-12*h* are all encased inside the interior space between the framing members, and thus effectively hidden from view.

As such, it will be appreciated that the manner by which transversely-oriented framing members are secured to one another in an interlocking relationship and drawn together under tension by a tensioning mechanism are fundamentally similar for each of the example furniture components illustrated in FIGS. 1-21. Additional embodiments utilizing the principles discussed herein, as well as additional features such as bracing, alternate bed configurations and overforking members, are discussed in greater detail in the aforementioned cross-referenced provisional application, and in particular in FIGS. 18-44 and the accompanying text describing the same, which are expressly incorporated by reference herein.

While the present invention has been illustrated by a description of various embodiments, and while these embodiments have been described in some detail, they are not intended to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with methods of practicing the present invention as currently known. However, the invention itself should only be defined by the appended claims.

What is claimed is:

1. A knock-down furniture component, comprising:

a plurality of framing members configured to engage one another in an interlocking relationship, the plurality of framing members including first and second framing members, wherein at least two framing members among the plurality of framing members are oriented in a generally transverse orientation relative to one another;

one of said first and second framing members being generally planar and the other of said first and second framing members being generally elongated and having a longitudinal axis, said generally elongated framing member having an end surface generally normal to the longitudinal axis of said generally elongated framing member, said generally planar framing member having a generally planar surface;

said framing members being arranged such that the longitudinal axis of said generally elongated framing member is generally normal to said generally planar surface of said generally planar framing member, said framing members being further arranged such that said end surface of said generally elongated framing member abuts said planar surface of said generally planar framing member;

first and second anchor points respectively coupled to the first and second framing members and separated along a linear axis; and at least one tensioning device that applies tension along the linear axis and between the first and second anchor points to draw the plurality of framing members together under tension in the interlocking relationship, the linear axis being generally parallel to the longitudinal axis of said generally elongated framing member, said tensioning device extending along substantially an entire longitudinal extent of said generally elongated framing member.

2. The knock-down furniture component of claim 1, wherein the at least one tensioning device includes a first tensioning device engaging the first and second anchor points.

3. The knock-down furniture component of claim 2, wherein the first anchor point is integrally formed in the first framing member.

4. The knock-down furniture component of claim 2, wherein the first anchor point is mounted to the first framing member.

5. The knock-down furniture component of claim 2, wherein the first framing member includes a slot, and wherein the first anchor point includes a position anchor interlocked with the slot of the first framing member.

6. The knock-down furniture component of claim 2, wherein the second framing member comprises a corner anchor that includes the first anchor point and that is configured to interlock with the first framing member and with a third framing member, the corner anchor further configured to maintain the first and third framing members in a generally transverse orientation relative to one another.

7. The knock-down furniture component of claim 6, wherein the first tensioning device engages the first anchor point to draw the first and second framing members together under tension in the interlocking relationship, and wherein the furniture component further comprises a second tensioning device that engages the first anchor point to draw the first and third framing members together under tension in an interlocking relationship.

8. The knock-down furniture component of claim 7, wherein the first, second and third framing members comprise bed frame members.

9. The knock-down furniture component of claim 2, wherein the first tensioning device includes:

at least one tensioning member configured to apply tension between the first and second anchor points; and a securing mechanism coupled to the at least one tensioning member and configured to control the tension applied through the at least one tensioning member.

10. The knock-down furniture component of claim 9, wherein the tensioning member comprises a strap, a cord, a band, a rope, a belt, a cable, a wire, a chain, or a rod, and wherein the securing mechanism comprises a ratchet or a winch.

11. The knock-down furniture component of claim 9, wherein the at least one tensioning member loops around the first and second anchor points.

12. The knock-down furniture component of claim 9, wherein the first tensioning device further comprises first and second hooks disposed at opposing ends of the at least one tensioning member and engaging the first and second anchor points, respectively.

13. The knock-down furniture component of claim 2, wherein the first tensioning device comprises a come-a-long that includes a ratchet configured to tension a strap extending between the first and second anchor points.

14. The knock-down furniture component of claim 1, wherein the furniture component comprises a table, a stool, a chair, a shelf or a bookshelf.

15. A knock-down furniture component, comprising:

first and second anchor points opposing one another along an axis;

a planar framing member coupled to the first anchor point and having a planar surface, wherein the axis is substantially normal to the planar surface of the planar framing member;

an elongated framing member extending along the axis with at least a portion thereof interposed between the first and second anchor points, the elongated framing member including first and second ends and an interior channel disposed therebetween and extending along substantially an entire longitudinal extent of said elongated framing member, wherein the planar and elongated framing members are configured to engage one another along the axis in an interlocking relationship, one of said first and second ends of said elongated framing member abutting said planar surface of said planar framing member; and at least one tensioning device that applies tension between the first and second anchor points and draws the planar and elongated framing members together under tension in the interlocking relationship, wherein at least a portion of the tensioning device extends through the interior channel of the elongated framing member.

16. The knock-down furniture component of claim 15, further comprising a second planar framing member disposed proximate the second end of the elongated framing member and configured to engage with the elongated framing member in an interlocking relationship.

17. The knock-down furniture component of claim 15, wherein the planar framing member comprises a table top.

18. The knock-down furniture component of claim 15, wherein the planar framing member comprises a seat.

19. The knock-down furniture component of claim 15, wherein the planar framing member comprises a shelf.

* * * * *